US006202582B1

(12) United States Patent
Risley

(10) Patent No.: US 6,202,582 B1
(45) Date of Patent: Mar. 20, 2001

(54) ASYMMETRICALLY SHAPED SAILBOAT

(76) Inventor: Jerome Risley, P.O. Box 23, Athens, NY (US) 12015

( * ) Notice: Subject to any disclaimer, the term of this patent is extended or adjusted under 35 U.S.C. 154(b) by 0 days.

(21) Appl. No.: 09/220,396

(22) Filed: Dec. 24, 1998

(51) Int. Cl.[7] ..... B63H 9/04
(52) U.S. Cl. ..... 114/102.33; 114/39.26
(58) Field of Search ..... 114/39.21, 39.26, 114/39.28, 39.29, 61.1, 61.11, 61.12, 61.15, 61.2, 95, 97, 98, 102.32, 102.33, 104, 106, 107, 163

(56) References Cited

U.S. PATENT DOCUMENTS

| | | | | |
|---|---|---|---|---|
| 3,173,395 | | 3/1965 | Laurent | 114/39.26 |
| 3,223,065 | | 12/1965 | Wilson, Jr. | 114/39.26 |
| 3,585,955 | * | 6/1971 | Cella | 114/61.21 |
| 3,777,690 | * | 12/1973 | Garber | 114/39.22 |
| 4,054,100 | | 10/1977 | Rineman | 114/39.26 |
| 4,192,247 | | 3/1980 | Riordan | 114/39.28 |
| 4,457,248 | | 7/1984 | Thurston | 114/61.11 |
| 4,503,795 | | 3/1985 | Krans | 114/39.25 |
| 4,503,797 | | 3/1985 | Maurin | 114/106 |
| 4,522,142 | * | 6/1985 | Frye, Jr. | 114/163 |
| 4,584,957 | | 4/1986 | Belvedere | 114/39.28 |
| 4,612,868 | * | 9/1986 | Reynolds | 114/39 |
| 4,879,961 | | 11/1989 | Aguilera | 114/102.22 |
| 5,003,903 | * | 4/1991 | Olsen | 114/102 |
| 5,263,429 | | 11/1993 | Brinkmann | 114/105 |
| 5,373,799 | * | 12/1994 | Green | 114/61 |
| 5,592,892 | * | 1/1997 | Kerckhoff | 114/39.16 |
| 5,617,805 | * | 4/1997 | Frigard | 114/39.1 |
| 5,664,979 | | 9/1997 | Benham | 441/79 |
| 5,724,905 | | 3/1998 | Pizzey | 114/39.14 |

FOREIGN PATENT DOCUMENTS 2 128 153 4/1984 (GB) .

* cited by examiner

*Primary Examiner*—S. Joseph Morano
*Assistant Examiner*—Andrew D. Wright
(74) *Attorney, Agent, or Firm*—Schmeiser, Olsen & Watts

(57) ABSTRACT

A sailboat symmetrical in the longitudinal direction, but asymmetrical in a cross-sectional plane perpendicular to the longitudinal axis. The sailboat includes a main hull, a mast, a yardarm pivotally attached to a head of the mast, and a sail attached to the yardarm. Also, there is a sponson, a keel section and an outrigger hull. A system for automatically joining the sail sections, as the sail is lowered from the yardarm and a system for automatically separating the sail sections, as the sail is raised onto the yardarm. A system for rotatably pivotally attaching the mast to the main hull. Rudders mounted in the keel and tillers having resilient control elements.

14 Claims, 11 Drawing Sheets

ASYMMETRICALLY SHAPED SAILBOAT

FIELD OF THE INVENTION

The present invention relates generally to monohull and multihull sailboats, and more particularly relates to sailboats of the general type of sailboat known as a proa.

BACKGROUND OF THE INVENTION

Proa type sailboats are well known in the related art. A proa sailboat typically has two hulls with bows or water cutting pointed ends on each end of the hulls. The hulls are substantially symmetrical about a longitudinal transverse center line, so that the sailboat can move in either direction with equal facility. Typically, there is a larger size main hull and a smaller size outrigger hull outwardly attached from the main hull. Also, the outrigger hull is attached on the windward side of the main hull, which is the side of the main hull that the wind first passes over. A platform can cover the area between the two hulls. Also, the mast and sail are mounted on the main hull, with one corner of the essentially isosceles triangular shaped sail attached to the top of the mast. Normally, the proa sailboat does not include a boom, and the bottom edge of the sail remains essentially parallel to the water surface, for all directions of sailing. Normally the main hull includes a rudder at each end to steer or change the direction of the sailboat. During sailing, the operator normally sits over the outrigger hull or on the platform located between the main hull and the outrigger hull.

In operation, a proa can be maneuvered to sail downwind, across the wind or upwind by tacking. In sailing upwind, the procedure differs from that which is practiced by a conventional sailboat having a pointed bow and a flat stern. In a conventional sailboat, during tacking, the bow is always the leading end of the boat. Also, in a conventional sailboat, in order to sail upwind the sailboat must change directions (tack) so that the wind blows over first one side of the sailboat and then when the sailboat direction changes, the wind then blows over the other side of the boat. When the boat changes its direction, the sail and the boom swing over to the other side of the sailboat. Since the boat changes directions, and the wind comes over first one side and then over the other side of the sailboat, a conventional sailboat is designed to be symmetrical in a cross-section perpendicular to the longitudinal axis of the hull.

For a proa, in moving upwind, the wind will always blow over the same one side of the sailboat. In tacking, the sail is adjusted and the rudder is moved such that the sailboat changes directions where the leading end going forwards before a tack becomes the trailing end going backwards after the tack. The side of the sailboat that the wind passes over first is known as the windward side, and the opposite side of the sailboat is known as the leeward side. Therefore in a proa, the windward side is always the same side of the sailboat.

SUMMARY OF THE INVENTION

The present invention provides many improvements over a conventional proa type sailboat. One object of the present invention is to provide a sailboat with a main hull that will have an optimum shape for the sailboat at rest, under way with light winds and under way in heavy winds. Attached to the main hull is an outrigger hull. The outrigger hull is attached to the main hull with telescoping arms that are resiliently mounted to the main hull. Being unlike a typical proa, in the present invention, the operator sits in the main hull and the outrigger hull extends outwardly from the main hull from the leeward side rather than from the windward side of the main hull.

Taken in a cross-section perpendicular to the longitudinal axis of the main hull, the sailboat of the present invention is asymmetrically shaped. Hereafter, in the present invention, the side of the main hull that has the extendable outrigger hull will be referred to the "leeward" side of the sailboat, and the side of the main hull that does not have the outrigger hull will be referred to as the "windward" side of the sailboat. When the sailboat is at rest and not moving, the main hull includes an essentially flat portion of the main hull that lies essentially parallel to the water surface. A keel is rigidly attached to the main hull and traverses down the longitudinal underwater length of the main hull. The keel can be mounted so that the bottom of the keel leans toward the leeward side of the main hull. This mounting allows the keel to lie essentially in a perpendicular direction to the water surface when the sailboat is in heavy winds that cause the sailboat to tip toward the leeward side of the sailboat. The keel helps prevent the sailboat from being pushed sideways by the wind force, and by being perpendicular to the water surface, the keel presents a greater surface area to counteract the sideways wind force. The flat portion of the main hull, extends outwardly from the keel to the windward side of the main hull. In addition, a sponson protrudes from the flat portion of the main hull and forms a portion of the windward side of the main hull. In combination, when the sailboat is at rest, the flat portion of the main hull and the sponson provide buoyancy to support the weight of the sailboat and of an operator. At a dock, when the operator steps onto the windward side of the sailboat, the sailboat tips and causes the sponson to further enter the water providing additional buoyancy to support the weight of the operator. Therefore, the sponson can prevent the sailboat from tipping over when an operator is stepping onto the sailboat. Also, when the sailboat is at rest, the outrigger hull can be fully extended away from the main hull to prevent the sailboat from tipping over in the leeward direction, if the operator moves to the leeward side of the main hull. Also, the sailboat can be propelled with paddles or oars.

When the sailboat is moving under light wind conditions, a different portion of the main hull is in contact with the water. Since the wind is tipping the sailboat toward the leeward side, the sponson is now removed from the water, thereby eliminating the water drag that would be created by the sponson. In a light wind, the sailboat operator can move toward the windward side of the main hull, and can counteract the tipping force of the wind, so that the sailboat can sail in an upright position. In this upright position, the sponson and the outrigger hull are removed for the water. This results in minimal drag with only a portion of the main hull in contact with the water. The portion of the main hull in contact with the water includes a portion of the flat portion of the main hull along with a portion of the main hull referred to as the light wind portion of the main hull. Also, the keel attached to the main hull, helps prevent the sailboat from being pushed toward the leeward side. The light wind portion of the main hull extends upwardly from the keel to the leeward side of the main hull. In light winds, the sailboat main hull is not planing across the water surface but is acting as a displacement hull. With a displacement hull, the maximum speed of the hull is determined by the ratio of the hull length to the hull width, so that for a given hull length, the speed will increase as the width of the hull decreases. In the present invention, the hull shape in contact with the water in light wind conditions provides a configuration with a reduced width for a given main hull length and total weight being supported. In addition, when the sailboat is essentially in an upright position, the combination of the light wind portion of the main hull and the flat portion of the main hull form a V shape when viewed from the front of the sailboat. This V shape forms a long keel that extends down the length of the sailboat and helps prevent sideways motion toward the leeward side of the sailboat. Since this long main hull shape serves as a keel, the additional keel surface extending into the water can be reduced thereby reducing the water drag created by the keel.

When sailing in heavy winds, different portions of the sailboat are in contact with the water. The portion of the main hull in contact with the water includes a portion of the flat section of the main hull, the light wind portion of the main hull, and the leeward side portion of the main hull. In addition, the outrigger hull can be fully extended away from the leeward side of the main hull and can provide buoyancy support to prevent the sailboat from tipping over in the leeward direction. The outrigger hull is attached to the main hull deck by pivoting and extendable arms. The arms are pivotally attached to the main hull deck toward its windward side. On the leeward side of the main hull deck, the arms are resiliently attached so that during rough seas, the movement of the arms can help reduce the shock impact when the outrigger hull strikes the water surface.

In heavy winds, the sailboat is tipped toward the leeward side, causing the flat portion of the main hull to move toward a more upright vertical position. At the same time, the light wind portion of the main hull becomes essentially parallel to the water surface, and the leeward side of the main hull enters the water. The light wind portion of the main hull becomes a planing surface to allow the main hull to plane across the water surface. For a given length, a planing hull can travel much faster than a displacement hull. Therefore, during heavy winds, the speed of the sailboat increases when the main hull acts as a planing hull. The leeward side of the main hull is sloping toward the water surface and helps direct water away from the main hull deck. In a similar manner, the flat portion of the main hull and the sponson helps direct the water away from the main hull deck and also, provides lift to the sailboat, keeping the sailboat on top of the water surface in the event that a large wave strikes the sailboat. As previously mentioned, when the sailboat tips in a leeward direction, the keel is brought to an essentially perpendicular direction with respect to the water surface and thereby, has maximum effectiveness in counteracting the sideways force caused by the wind on the sail. The stability provided by the outrigger allows the sailboat to be operated by one person.

In heavy winds, another embodiment of the present invention allows the outrigger hull to be retracted into a position against the leeward side of the main hull, thus forming a single main hull. The single main hull configuration allows the operator and crew to sail a high performance planing monohull with the operator and crew extending their weight beyond the windward side of the sailboat. The outrigger retracted against the main hull reduces the drag caused by the outrigger when it is separate from the main hull. Also, the retracted outrigger hull position allows easier transportation and storage of the sailboat because of the minimum width presented by the sailboat when in a monohull configuration.

A mast is rotatably and pivotally attached to the main deck of the hull. Typically, the mast is mounted toward the leeward side of the main deck. The mast can be attached to the deck at an angle toward the windward side, so that the mast will be perpendicular to the water surface when the sailboat is tilting in strong winds. In addition to being able to rotate about its longitudinal axis, the mast can be tilted in a forward (fore) or backward (aft) direction, in order to shift the center of pressure of the sail. A mast support apparatus allows the mast to rotate and to be positioned fore and aft.

A yardarm is attached to a sail storing apparatus, and the sail storing apparatus is attached to a yardarm support apparatus that is attached to the top of the mast. The yardarm can be tubular in shape and the hollow inside of the tube can be filled with a closed cellular form material to aid in the flotation of the yardarm in case it falls into the water. In another embodiment, the yardarm can have an airfoil shape to reduce air drag and to provide increased lift for the sail. In the present invention, the entire sail is essentially in the shape of an isosceles triangle, with one side of the triangle attached to the yardarm.

One embodiment of the present invention, includes a sail including two halves slidingly fastened together by a device such as but not limited to a zipper. The zipper tab is fixedly attached to the sail storing apparatus so that as the sail is rolled onto the yardarm, the sail splits into two halves, with each half rolling onto a section of the yardarm. A halyard line passes through the yardarm support apparatus and is attached to the sail storing apparatus. When an operator pulls on one end of the halyard line, the other end of the halyard line attached to the yardarm support apparatus raises the yardarm to the top of the mast.

The center of the yardarm is pivotally mounted by the yardarm support apparatus so that the yardarm may be tilted in a direction causing the center of wind force on the sail to be move forward or aft of the mast. The tilting of the yardarm is controlled by an operator pulling on either a line attached to one end of the yardarm or pulling on a line attached to the opposite end of the yardarm. During sailing, the one free corner of the sail that is not attached to the yardarm is controlled by two control lines. These control lines are also used to unfurl the sail if the sail is furled on the yardarm. To furl the sail on the yardarm, the operator pulls on a furling line that is wound on a drum on the sail storing apparatus. The furling line causes the yardarm to rotate about its longitudinal axis. This yardarm rotation causes the sail to roll up in a stored position on the yardarm. Rather than a cylindrical shape, the yardarms can be an airfoil shape to reduce the drag of the leading edge of the sail.

Rudders are pivotally mounted in the keel, with one rudder located near one pointed end of the sailboat and with a second rudder located near the other pointed end of the sailboat. When the sailboat is traveling in a straight line, the rudders are located in the same plane as the keel in order to minimize water drag. For rudder control, the rudders are attached to rudder shafts which are in turn attached to tillers on the deck side of the main hull of the sailboat. A longitudinal resilient cord can be attached between the ends of the two tillers. Also, additional resilient cords can be attached between the tillers and the main deck in a direction perpendicular to the longitudinal axis of the main hull. These resilient cords help maintain the rudders in the same plane as the keel, unless the operator grasps a tiller to cause a rudder to rotate and change the direction of the sailboat.

In the present invention, the deck of the main hull includes a cockpit that can accommodate an operator and one crew member. Also, under the deck, is space in the main hull that can provide space for sleeping and storage space for supplies. Also, in the present invention, the main hull of the sailboat is about 16 feet long with a beam or width of about 3½ to 4 feet. The yardarm is about the same length as the main hull length. Of course, the sailboat can be constructed larger or smaller in size and the dimensions given are for illustration purposes only.

BRIEF DESCRIPTION OF THE DRAWINGS

The features of the present invention will best be understood from a detailed description of the invention and a preferred embodiment thereof selected for the purposes of illustration and shown in the accompanying drawings in which.

DETAILED DESCRIPTION OF THE INVENTION

Figure 1:
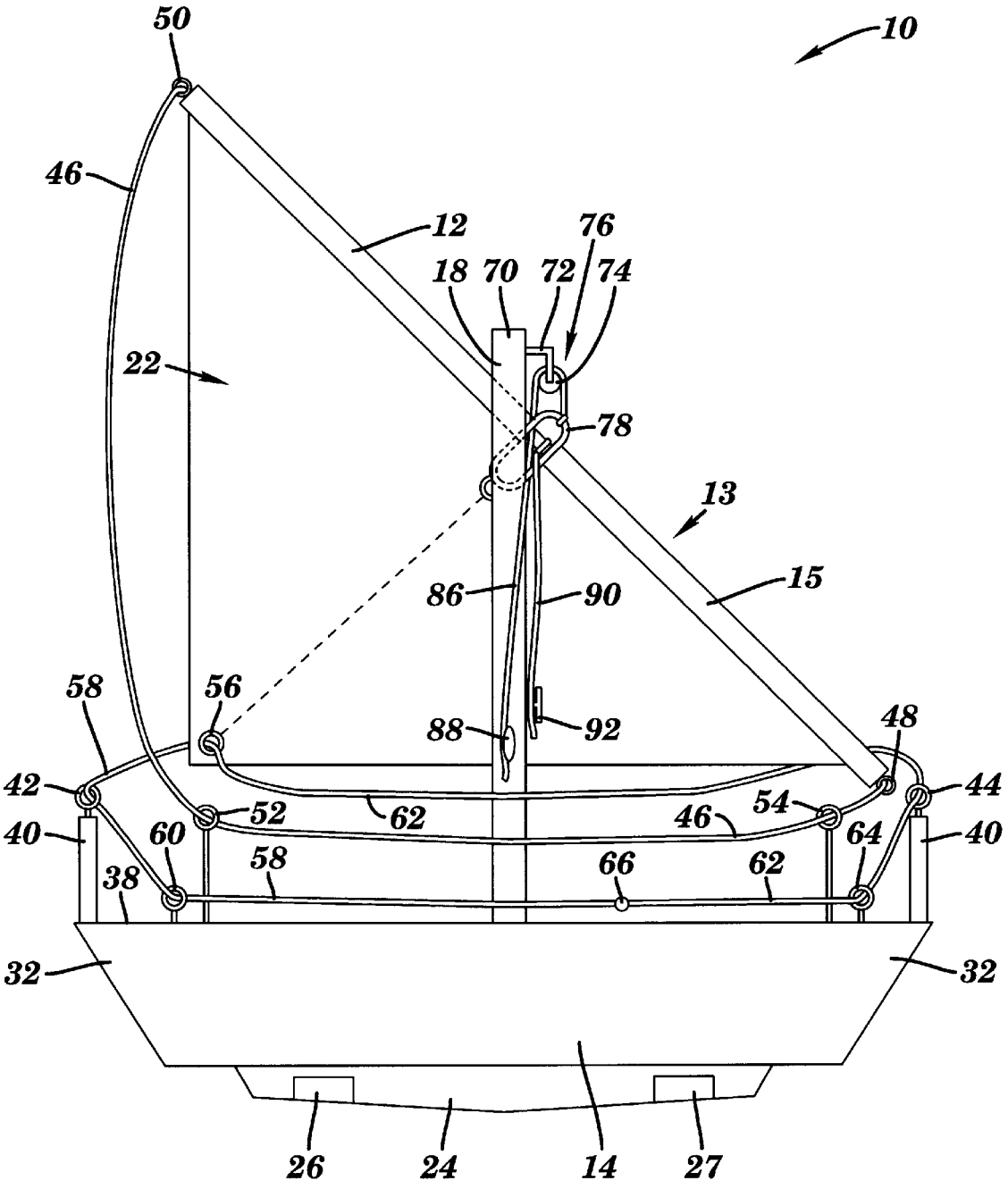
FIG. 1 illustrates a side view of the sailboat with the yardarm in a first position, in accordance with a first embodiment of the present invention.

Although certain preferred embodiments of the present invention will be shown and described in detail, it should be understood that various changes and modifications may be made without departing from the scope of the claims. The scope of the present invention will in no way be limited to the number of constituting components, the materials thereof, the shapes thereof, the relative arrangement thereof, etc., and are disclosed simply as an example of the preferred embodiment. The features and advantages of the present invention are illustrated in detail in the accompanying drawings, wherein like reference numerals refer to like elements throughout the drawings.

Figure 2:
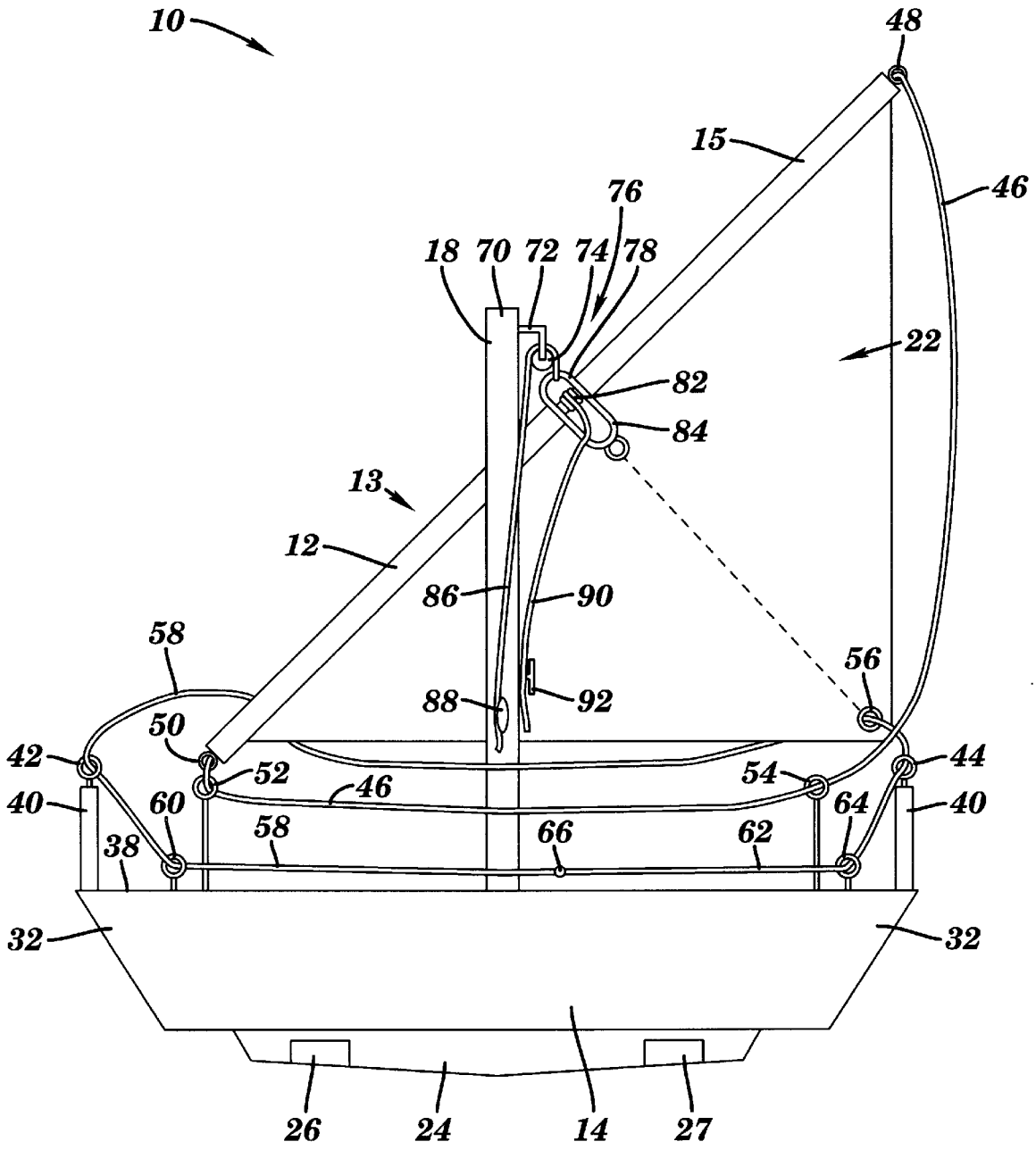
FIG. 2 illustrates a side view of the sailboat with the yardarm in a second position, in accordance with a first embodiment of the present invention.
Figure 3:
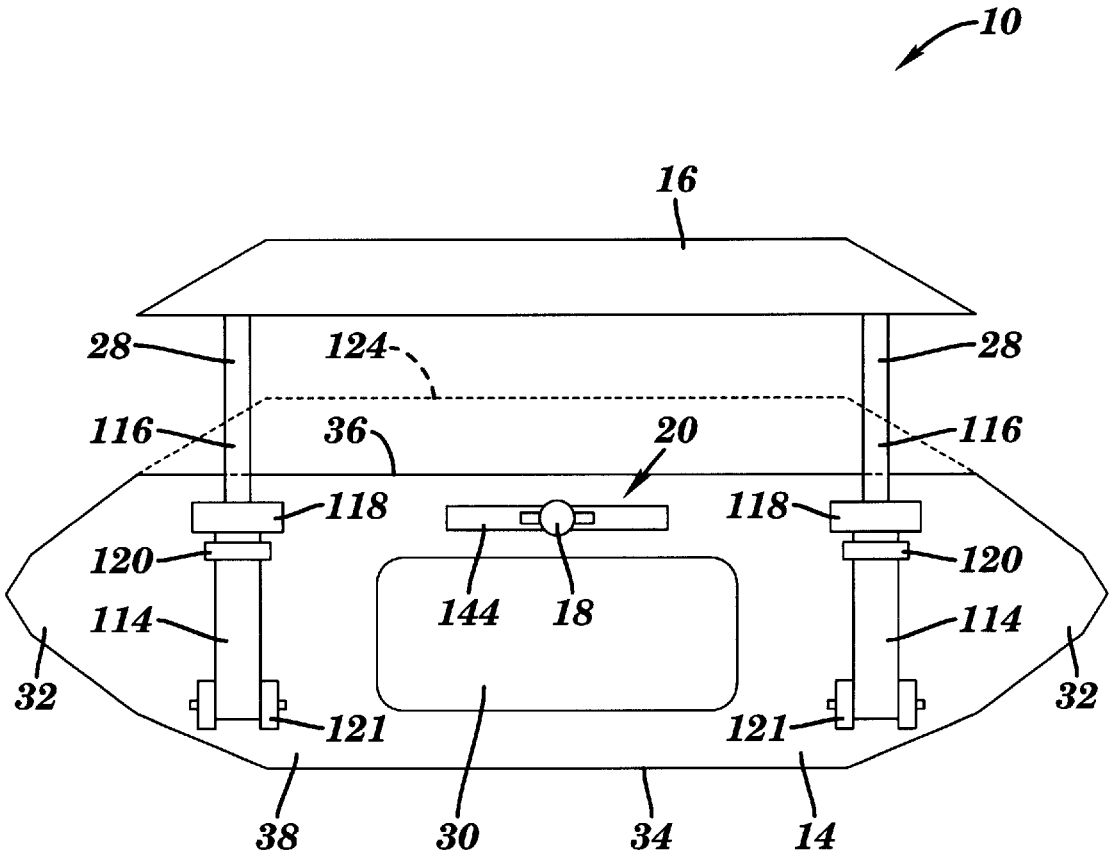
FIG. 3 illustrates a top plan view of the main hull and the outrigger hull of the present invention.

Referring to FIG. 1, there is illustrated a plan view of the sailboat 10 with a yardarm assembly 13. The yardarm assembly 13 includes a yardarm 12 and a yardarm 15 which lie along the same longitudinal axis. FIG. 1 illustrates the yardarm assembly 13 in a first position in accordance with a first embodiment of the present invention. FIG. 2 illustrates a plan view of the sailboat 10 with the yardarm assembly 13 in a second position, and FIG. 3 illustrates a top plan view of the sailboat 10. The sailboat 10 includes a main hull 14, an outrigger hull 16, a mast 18, a mast support apparatus 20, a sail 22, a keel 24, rudders 26 and 27, outrigger arms 28, and a cockpit 30. The main hull 14 has pointed ends 32, a windward side 34, a leeward side 36. During sailing, the wind always passes over the windward side 34 first, and then over the leeward side 36.

An operator and one crew member can be accomodated in the cockpit 30 located in the deck 38 of the main hull 14. Struts 40 support line guides 42 and 44. Referring to FIGS. 1 and 2, swiveling loops 48 and 50 are attached to the yardarms 12 and 15. A first end of a control line 46 is attached to the swiveling loop 50, then the control line 46 passes though line guides 52 and 54 and then the second end of the control line 46 is attached to the swiveling loop 48. When the yardarm 12 and 15 rotates about its longitudinal axis, the swiveling loops 48 and 50 prevent the line 46 from twisting.

Furthermore, the control line 46 may be clamped at the line guides 52 and 54 to hold the yardarm assembly 13 in a fixed angular position relative to the deck 38. Line guides 52 and 54 are attached to the deck 38.

Referring to FIGS. 1 and 2, a first end of a control line 58 is attached to the corner 56 of the sail 22 and then the control line 58 passes through a line guide 42 and through a line guide 60. A first end of control line 62 is attached to the corner 56 of the sail 22 and then the control line 62 passes through a line guide 44 and then through a line guide 64. A second end of the control line 58, and a second end of the control line 62 can be optionally attached together at location 66. Line guides 60 and 64 can include a line clamping mechanism that can clamp the control lines 58 and 62 respectively. Also, line guides 60 and 64 are attached to the deck 38. When sailing, control lines 58 and 62 are used to pull in or let out the corner 56 of the sail 22.

Figure 9:
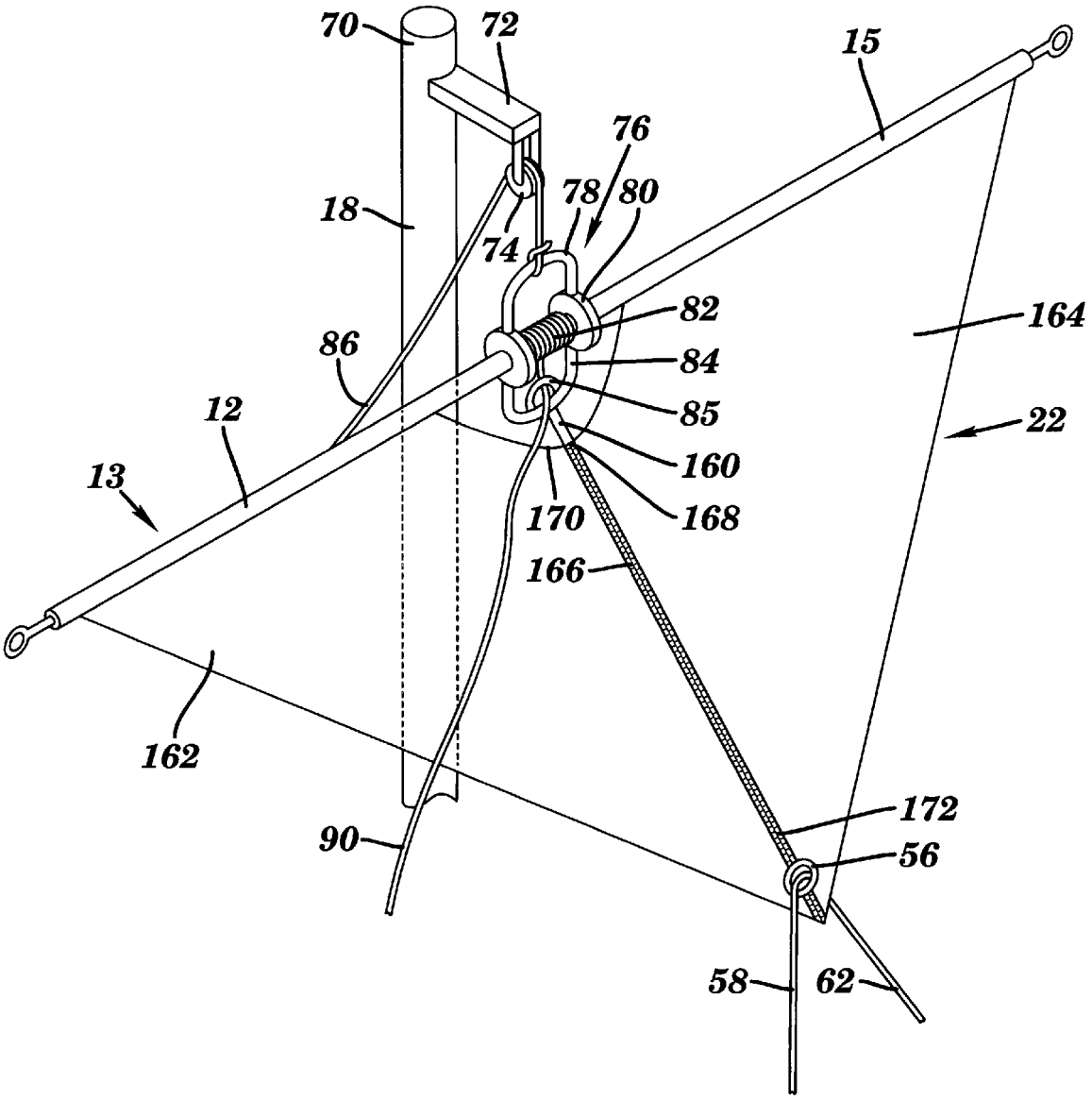
FIG. 9 illustrates a perspective view of the sail storing apparatus with the sail fully extended.

Attached to the head 70 of the mast 18 is a bracket 72, with a halyard pulley 74 attached to the bracket 72. Referring to FIG. 9, a sail rolling apparatus 76 includes a halyard loop 78, a halyard body 80, a drum 82, a furling loop 85, and a zipper tab holder 84. Yardarms 12 and 15 are rotatably supported by the halyard body 80, and are attached to drum 82, such that rotation of drum 82 causes rotation of the yardarms 12 and 15. A first end of the halyard line 86 is attached to the halyard loop 78, and passes over the halyard pulley 74. An operator pulling on the second end of the halyard line 86, causes the yardarm assembly 13 to be lifted to the head 70 of the mast 18. Referring to FIGS. 1 and 2, the operator can then tie the halyard line 86 to a cleat 88, thereby holding the yardarm assembly to the head 70 of the mast 18. A first end of the furling line 90 is attached to the drum 82, and a second end of the furling line 90 may be pulled by the operator causing the sail 22 to roll onto the yardarms 12 and 15. The furling line 90 can then be tied to the cleat 92.

Figure 4:
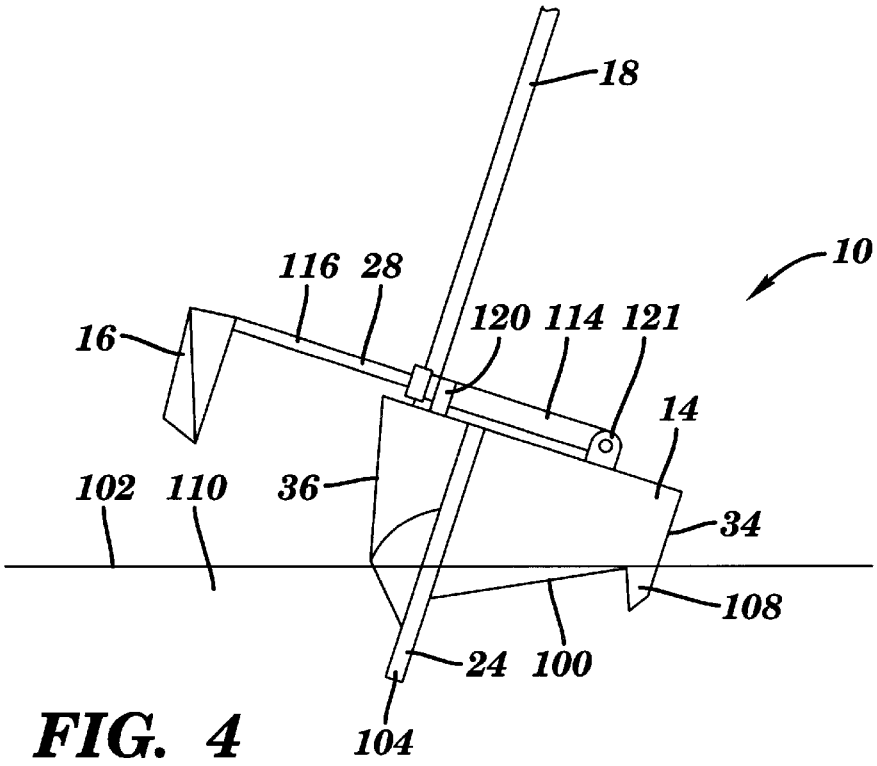
FIG. 4 illustrates a front plan view of the sailboat at rest.
Figure 6:
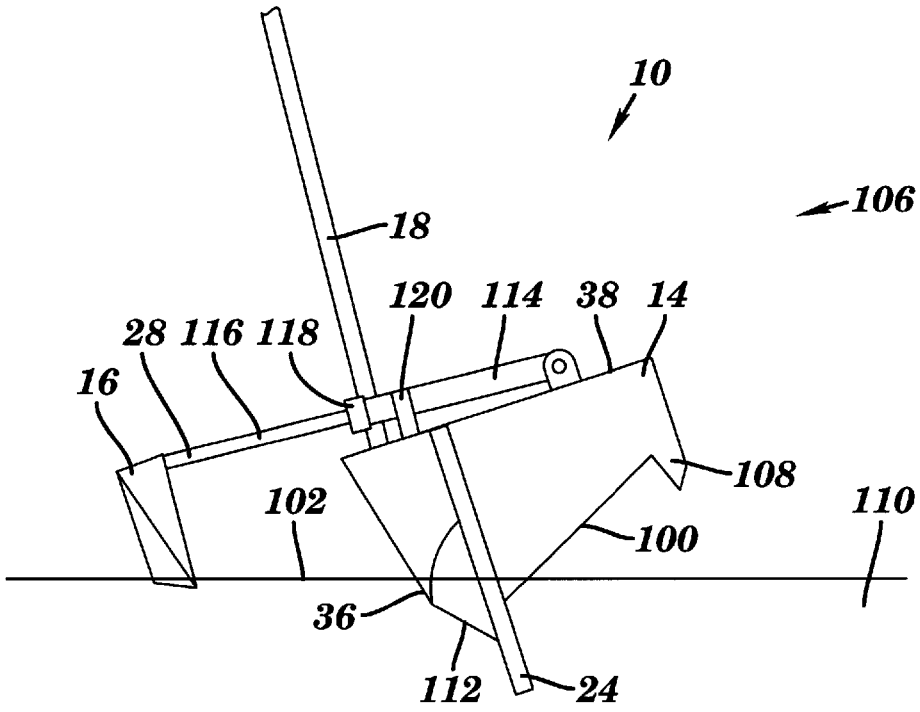
FIG. 6 illustrates a front plan view of the sailboat under heavy winds with the outrigger extended.

Illustrated in FIG. 4, is a front plan view of the sailboat 10 at rest. Taken in a cross-section perpendicular to the longitudinal axis of the main hull, the sailboat 10 is asymmetrically shaped. The asymmetrical shape allows the sailboat 10 to have an optimized surface in contact with the water for every wind condition and direction of sailing. When the sailboat 10 is at rest and not moving, the main hull 14, includes a flat portion 100 of that lies essentially parallel to the water surface 102. The keel 24 is rigidly attached to the main hull 14 and traverses down the longitudinal underwater length of the main hull 14. The keel 24 can be mounted so that the bottom 104 of the keel 24 leans toward the leeward side 36 of the main hull 14. This mounting allows the keel 24 to lie perpendicular to the water surface 102 when the sailboat 10 is in heavy winds causing the sailboat 10 to tip toward the leeward side 36 (FIG. 6). The keel 24 helps prevent the sailboat 10 from being pushed sideways by the wind force 106, and by being perpendicular to the water surface 102, the keel 24 presents a greater surface area to counteract the sideways wind force 106.

Referring to FIG. 4, the flat portion 100 of the main hull 14, extends outwardly from the keel 24 to the windward side 34 of the main hull 14. A sponson 108 protrudes from the flat portion 100 of the main hull 14, and forms a portion of the windward side 34 of the main hull 14. In combination, when the sailboat 10 is at rest, the flat portion 100 of the main hull 14 and the sponson 108, provide buoyancy to support the weight of the sailboat 10 and of an operator. At a dock, when the operator steps onto the windward side 34 of the sailboat 10, the sailboat tips and causes an additional portion of the sponson 108 to enter the water 110, in which case the sponson 108 provides additional buoyancy to support the weight of the operator. Therefore, the sponson 108 can prevent the sailboat 10 from tipping over when an operator is stepping onto the sailboat 10. Also, when the sailboat 10 is at rest, the outrigger arms 28, can be fully extended moving the outrigger hull 16 to a fully extended position away from the main hull 14. The outrigger hull 16 can therefore prevent the sailboat 10 from tipping over toward the leeward side 36 direction, if an operator transfers weight over to the leeward side 36 of the main hull 14. The operator can also retract the outrigger hull 16 against the main hull 14, and can use a paddle (not shown) to paddle the sailboat 10 in still water.

Figure 5:
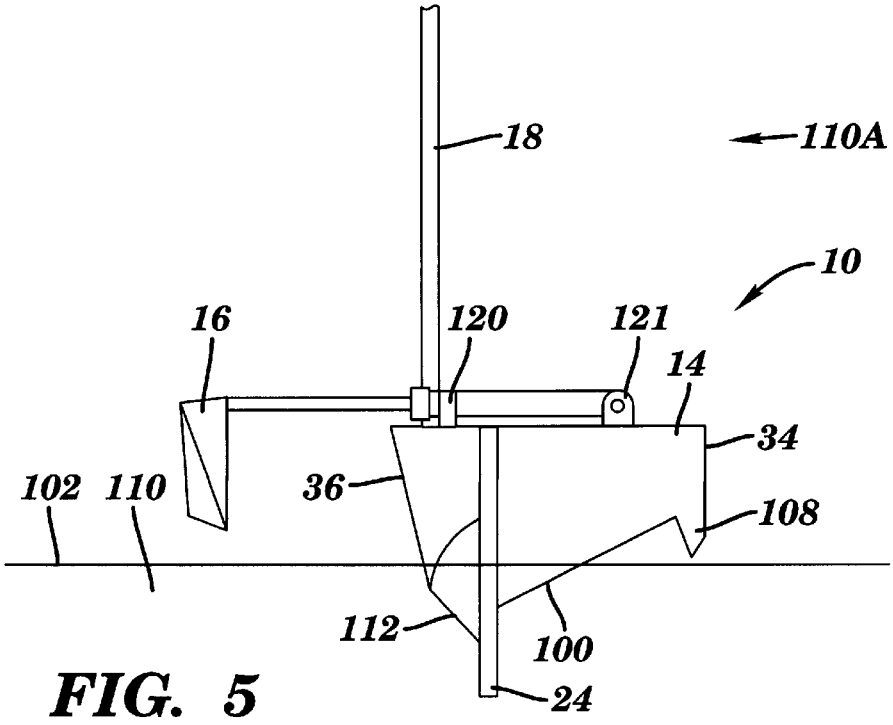
FIG. 5 illustrates a front plan view of the sailboat under light winds.

FIG. 5 illustrates a front plan view of the sailboat 10 under light winds. In light wind conditions, the wind 110A is tipping the sailboat 10 toward the leeward side 36, and the sponson 108 is removed from the water 110, thereby eliminating the water drag that would be created by the sponson 108. In a light wind the sailboat operator can move toward the windward side 34 of the main hull 14, and can counteract the tipping force of the wind, so that the sailboat 10 can sail in an upright position. In this upright position, both the sponson 108 and the outrigger hull 16 are both removed from the water 110. The main hull 14 in contact with the water 110 includes a portion of the flat portion 100 of the main hull 14, along with a portion of the main hull 14, referred to as the light wind portion 112 of the main hull 14. Also, the keel 24 attached to the main hull 14, helps prevent the sailboat 10 from being pushed toward the leeward side 36, by counteracting the sideways force of the wind. The light wind portion 112 of the main hull 14 is not planing across the water surface 102, but is acting as a displacement hull. In a displacement hull, the maximum speed of the hull is determined by the ratio of the hull length to the hull width, so for a given hull length, the speed will increase as the width of the hull decreases. In the present invention, the hull shape in contact with the water in light wind conditions provides a configuration with the minimum width for a given hull length and total weight being supported. In addition, as illustrated in FIG. 5, when the sailboat 10 is in an upright position, the combination of the light wind portion 112 of the main hull 14 and the flat portion 100 of the main hull 14 form a V shape when viewed from the front of the sailboat 10. This V shape form extends down the length of the sailboat 10, and helps prevent sideways motion toward the leeward side 36 of the sailboat 10. Since this shape serves as a keel, the actual keel 24 surface extending into the water 110 can be minimized, thereby minimizing the water drag created by the keel 24.

FIG. 6 illustrates a front plan view of the sailboat 10 under heavy winds with the outrigger hull 16 fully extended. In heavy winds, the sailboat 10 is tipped toward the leeward side 36, causing the sponson 108 to be completely removed from the water 110. The portion of the main hull 14 in contact with the water 110, includes a portion of the flat portion 100 of the main hull 14, along with the light wind portion 112 of the main hull 14, the leeward side 36 of the main hull 14, and the outrigger hull 16.

Also, the flat portion 100 of the main hull 14 is in a more upright vertical position. At the same time, the light wind portion 112 of the main hull 14 becomes a planing surface allowing the main hull 14 to plane across the water surface 102. For a given length, a planing hull can travel much faster than a displacement hull, so therefore during heavy winds, the speed of the sailboat 10 increases when the main hull 14 acts as a planing hull. The leeward side 36 of the main hull 14 is sloping toward the water surface 102, and helps direct water 110 away from the main hull 14 deck 38. In a similar manner, the flat portion 100 of the main hull 14, and the sponson 108 help direct the water away from the deck 38, and also provide lift to the sailboat 10, keeping the sailboat 10 on top of the water surface, in the event that a large wave strikes the sailboat 10. As previously mentioned, when the sailboat 10 tips toward the leeward side 36, the keel 24 is brought to a perpendicular direction with respect to the water surface 102, and thereby, has maximum effectiveness in counteracting the sideways movement caused by the wind 106 on the sail 22 (not shown).

In addition, the outrigger hull 16 can be fully extended away from the leeward side 36 of the main hull 14, and can provide buoyancy support to prevent the sailboat 10 from tipping over toward the leeward side 36. The outrigger hull 16 is attached to the deck 38 by pivoting and extendable outrigger arms 28. As illustrated in FIGS. 3 and 6, the outrigger arms 28 include outer struts 116, slidably received in inner struts 114. For each outrigger arm 28, a first end of the outer strut 116 is attached to the outrigger hull 16. A second end of the outer strut 116 is received in a first end of the inner strut 114. The outer struts 116 can be locked in a given position relative to the inner struts 114 by means of clamps 118. A second end of the inner strut 114 is pivotally attached to the deck 38 by a bracket 121. A first end of a resilient member 120 is attached to the inner strut 114 and a second end of the resilient member 120 is attached to the deck 38. Referring to FIG. 6, during rough seas, the resilient member 120 allows the outrigger arm 28 to move relative to the deck 38. This movement helps reduce the shock impact that occurs when the outrigger hull 16 impacts the water surface 102. The resilient member 120 can be, but is not limited to a resilient material such as rubber.

Figure 7:
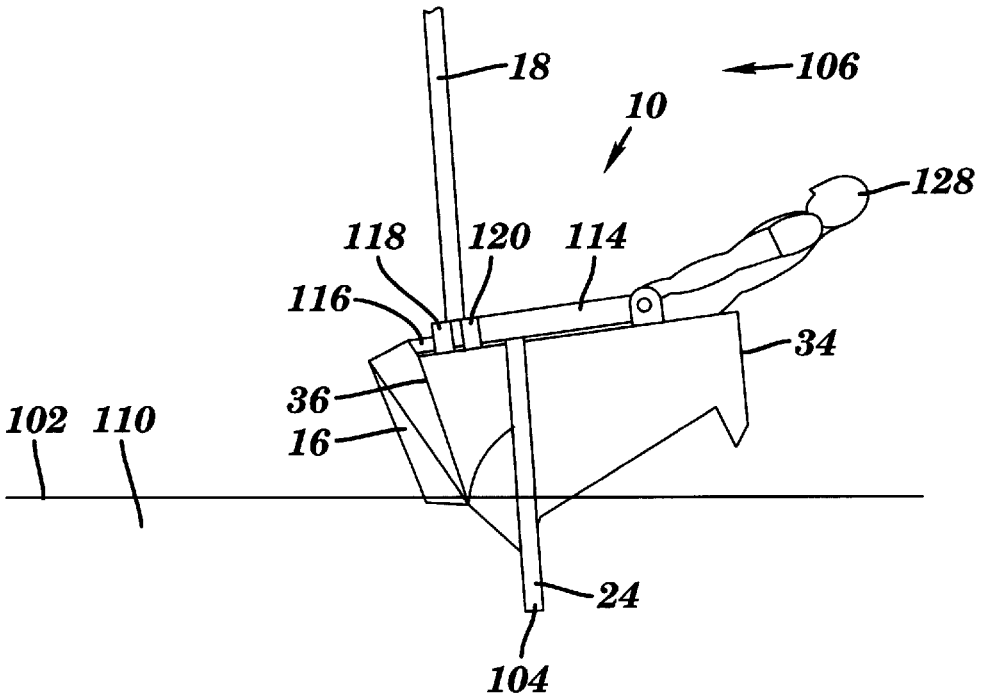
FIG. 7 illustrates a front plan view of the sailboat under heavy winds with the outrigger retracted.

In heavy winds, referring to FIG. 7, another embodiment of the present invention, allows the outrigger hull 16 to be retracted into a position against the leeward side 36 of the main hull 14, forming a single main hull 14. The clamp 118 on each outrigger arm 28 is loosened allowing the outer strut 116 to move within the inner strut 114, until the outrigger hull 16 is brought into contact with the main hull 14. Then the clamp 188 in tightened locking the outer strut 116 to the inner strut 114. In FIG. 3, the retracted outrigger hull 16 position is illustrated by a phantom line 124. With the outrigger hull 16 in contact with the leeward side 36 of the main hull 14, as shown in FIG. 7, an operator 128 and an optional crew member can sail the sailboat 10 in a planing monohull configuration. This monohull sailing provides an exciting challenge to the operator 128 and the optional crew member because they must extend their weight beyond the windward side of the main hull 14, in order to keep the sailboat 10 from being tipped over by the strong wind 106. The retracted outrigger hull 16 reduces the drag compared to an extended outrigger hull 16, thereby increasing the sailboat 10 speed. The retracted outrigger hull 16 position, also provides easier transportation and storage of the sailboat 10, because of the reduced width presented by the sailboat 10.

Figure 8:
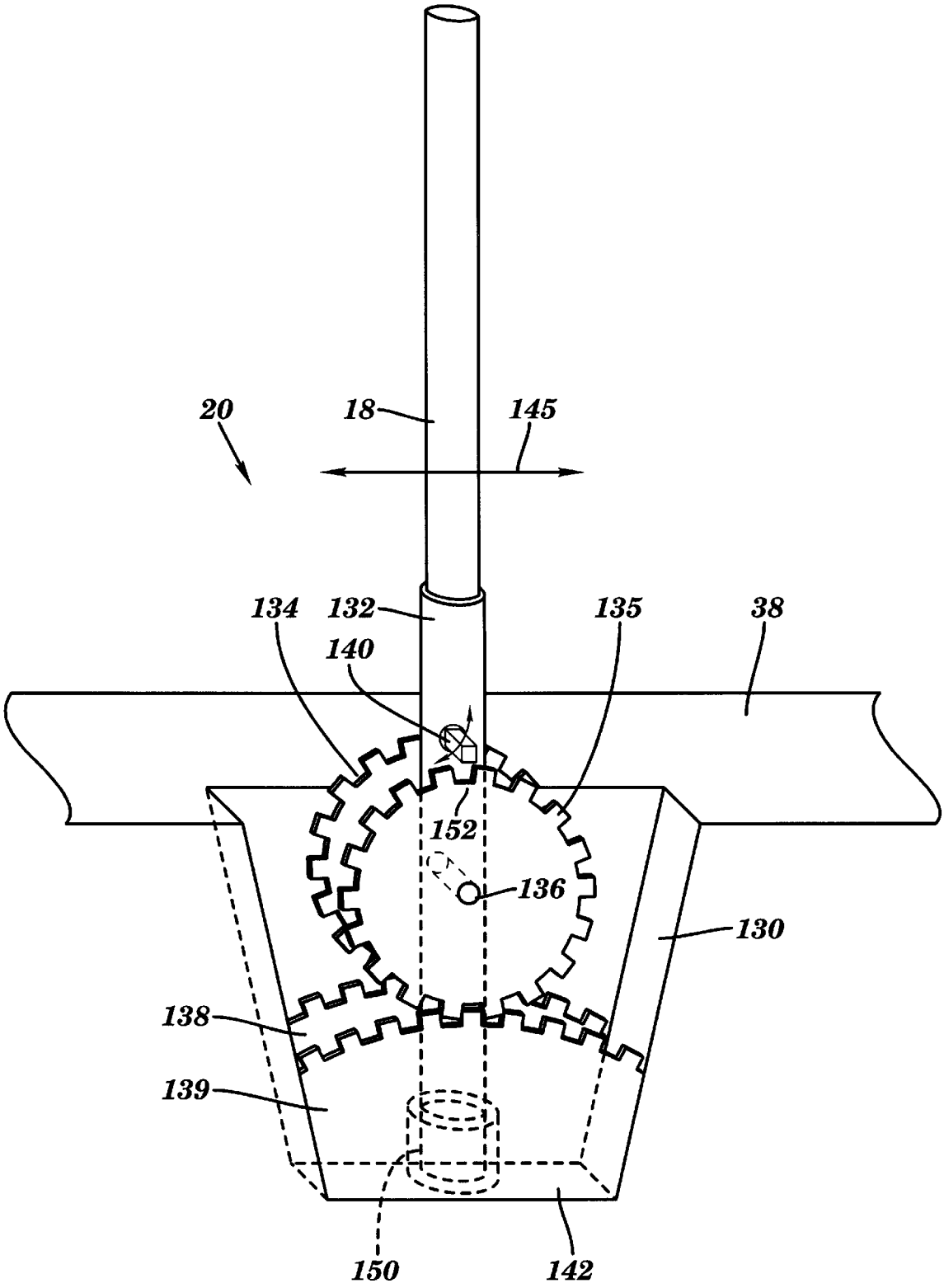
FIG. 8 illustrates a partial cross-sectional plan view of the mast tilting apparatus.

Referring to FIG. 3, the mast 18, is rotatably and pivotally attached to the deck 38, and is mounted toward the leeward side 36 of the deck 38. The mast 18 can also be mounted in a fixed position, leaning toward the windward side 34, so that the mast 18 can be essentially perpendicular to the water surface 102 when the sailboat 10 leans toward the leeward side 36. FIG. 8 illustrates the mast support apparatus 20 mounted in a housing 130 in the main deck 38. The vertical wall 144 shown in FIG. 3 is not shown in the cross-sectional perspective view of FIG. 8. The mast support apparatus 20 includes a mast sleeve 132, gears 134 and 135, a shaft 136, gear racks 138 and 139, a socket 150, and a locking lever 140. The mast 18 is pivotally received in a first end of the mast sleeve 132, allowing the mast 18 to rotate relative to the deck 38. A second end of the mast sleeve 132 rests in a socket 150. The socket 150 is attached to the bottom surface 142 of the housing 130. The gears 134 and 135 and the mast shaft 132 are pivotally mounted on the shaft 136, with the mast sleeve 132 positioned between the gears 134 and 135. Gear racks 138 and 139 are rigidly attached to the housing 130. The gears 134 and 135 engage with the gear racks 138 and 139, and allow the mast 18 to move in a fore and aft direction shown by the arrow 145 in FIG. 8. The locking lever 140 is pivotally attached to the mast sleeve 132 and can rotate in an upward and downward direction. When rotated in a downward direction, the locking lever 140 engages one of the notches 152 in the gear 135 and allows the operator to lock the mast 18 in a fixed fore and aft location. When pivoted in an upward direction, the locking lever 140 disengages with the notch 152 in the gear 135, and thereby allows the operator to move the mast 18 in a fore and aft direction 144.

Figure 10:
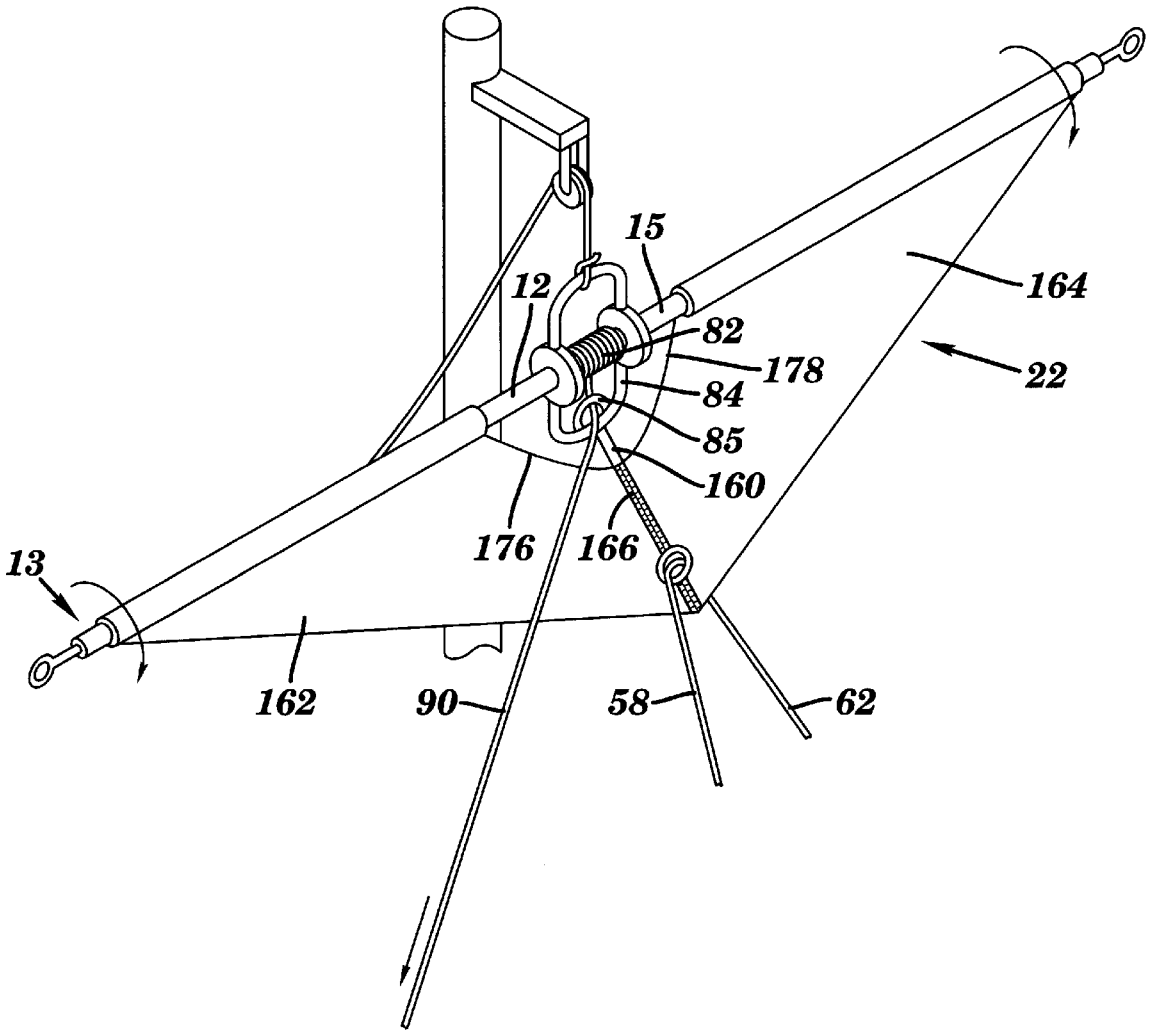
FIG. 10 illustrates a perspective view of the sail storing apparatus with the sail nearly completely stored.

FIGS. 9 and 10 illustrate the sail rolling apparatus 76, used to store the sail 22. In FIG. 9, control lines 58 and 62 are pulled in a downward direction, causing the sail 22 to become fully extended. The sail 22 has two elements 162 and 164 that are joined together by a slidable fastener, such as but not limited to a zipper 166. A first end 168 of the zipper 166 starts at a top edge 170 of the sail 22, and a second end 172 of the zipper 166 ends at a location 172 located near the corner 56 of the sail 22. The zipper 166 is opened and closed by a zipper tab 160. The zipper tab 160 is attached to the zipper tab holder 84. As the sail 22 extends, the yardarms 12 and 15, and the drum 82 rotate causing the furling line 90 to wind on the drum 82. The furling line 90 is guided on the drum by the furling loop 85. At the same time, the zipper tab 160 causes the two elements 162 and 164 of the sail 22 to join together.

FIG. 10 illustrates the sail 22 being stored on the yardarm assembly 13. To store the sail 22, the operator, pulls the furling line 90 in a downward direction causing the drum 82, and the yardarms 12 and 15 to rotate. The rotation of the yardarms 12 and 15, cause the two sail elements 162 and 164 to roll on the yardarms 12 and 15. As the two sail elements 162 and 164 are drawn in an upward direction, the zipper tab 160 causes the zipper 166 to split into the unzipped elements 176 and 178, and thereby allowing the sail elements 162 and 164 to split apart and to be rolled onto the yardarms 12 and 15.

Figure 11:
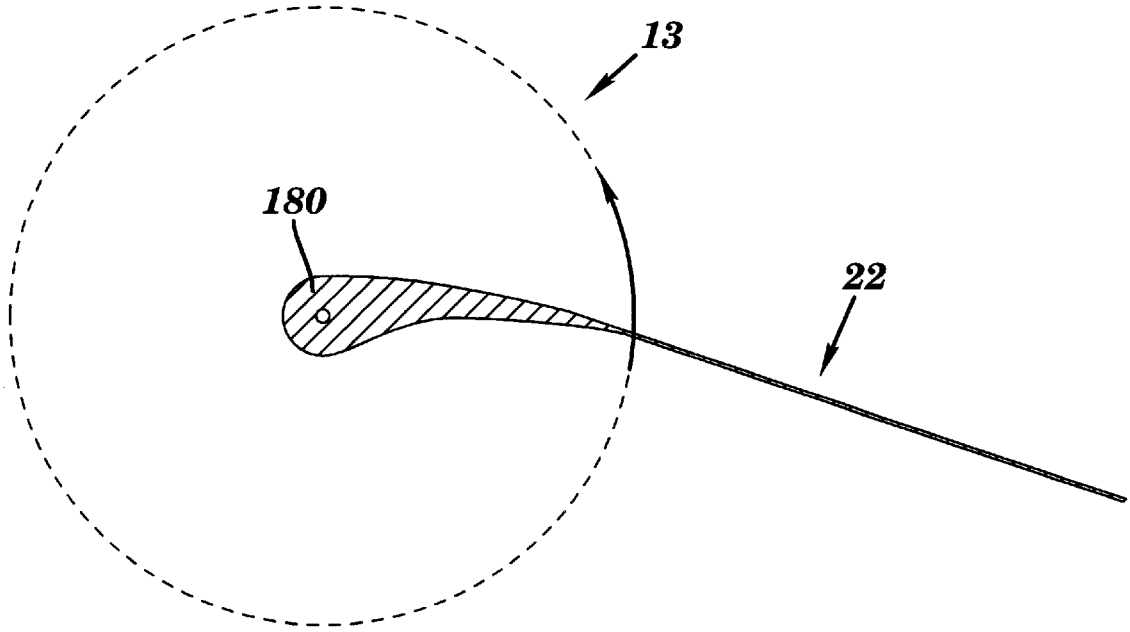
FIG. 11 illustrates a cross-sectional view of another embodiment of the yardarm.

FIG. 11 illustrates the cross-sectional shape of another embodiment of the yardarm assembly 13. In this embodiment, the yardarm assembly 13 rather than having a circular cross-section, has an airfoil 180 cross-section, in order to reduce the drag caused by separated flow. The sail 22 can be rolled and stored in a similar fashion, as has been described for FIG. 10. The yardarm assembly 13, can be filled with, but is not limited to a material such as a closed cellular foam buoyancy type material. The buoyancy material will aid in the flotation of the yardarm assembly 13 in case it falls in the water. Also, the foam type material can provide stiffening to the yardarms 12 and 15.

Figure 15:
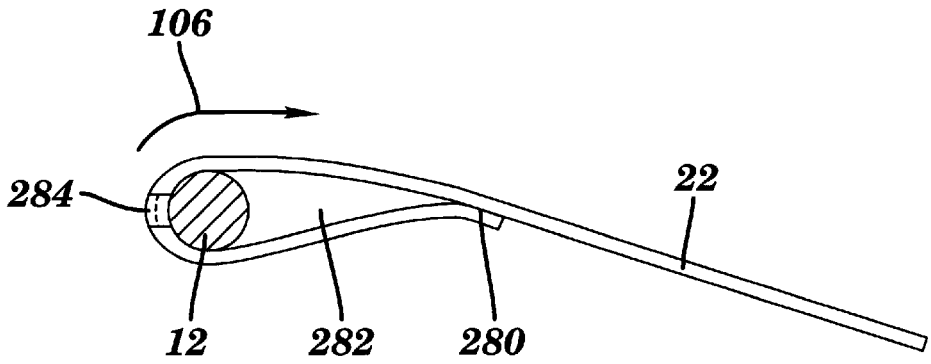
FIG. 15 illustrates a cross-sectional view of another embodiment of the sail attached to the yardarm.

Another embodiment of the sail 22 attachment to a yardarm 12 is illustrated in FIG. 15. A cross-sectional view of a cylindrical yardarm 12 is illustrated with a sail 22. The sail 22 is attached to itself at location 280, by sewing or other suitable means. A pocket 282 is formed and the sail is slid over the yardarm 12, and attached by the use of snaps 284 to the yardarm 12. The attachment means is not limited to snaps 284, but can include other means, such as but not limited to hook and eye fasteners. The pocket 282 forms an airfoil shape that reduces the drag and provides lift with the wind 106 passing over the yardarm 12.

Figure 12:
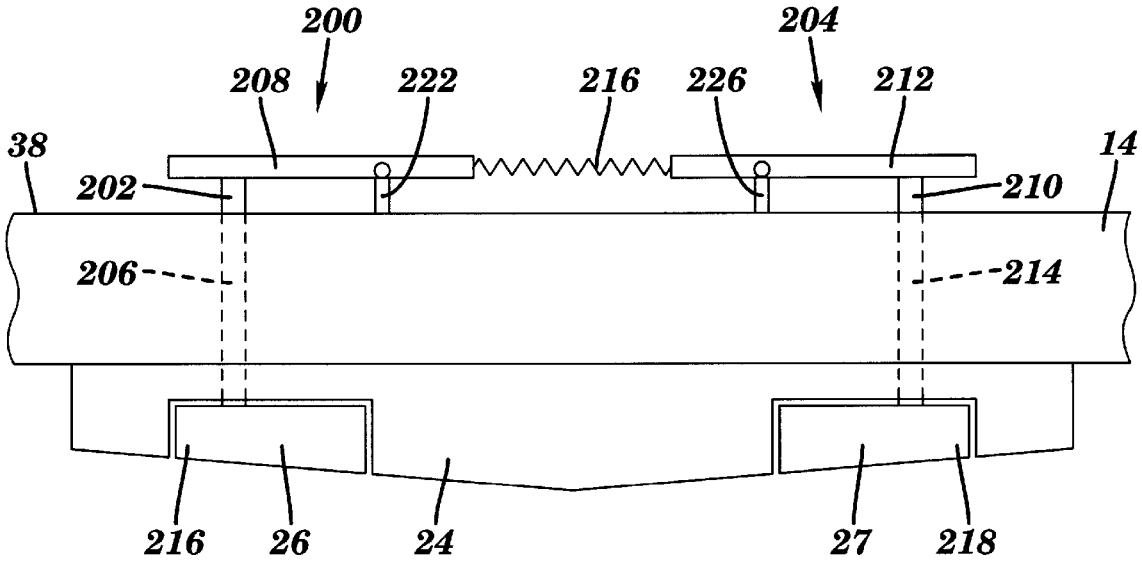
FIG. 12 illustrates a side view of the rudder assembly.
Figure 13:
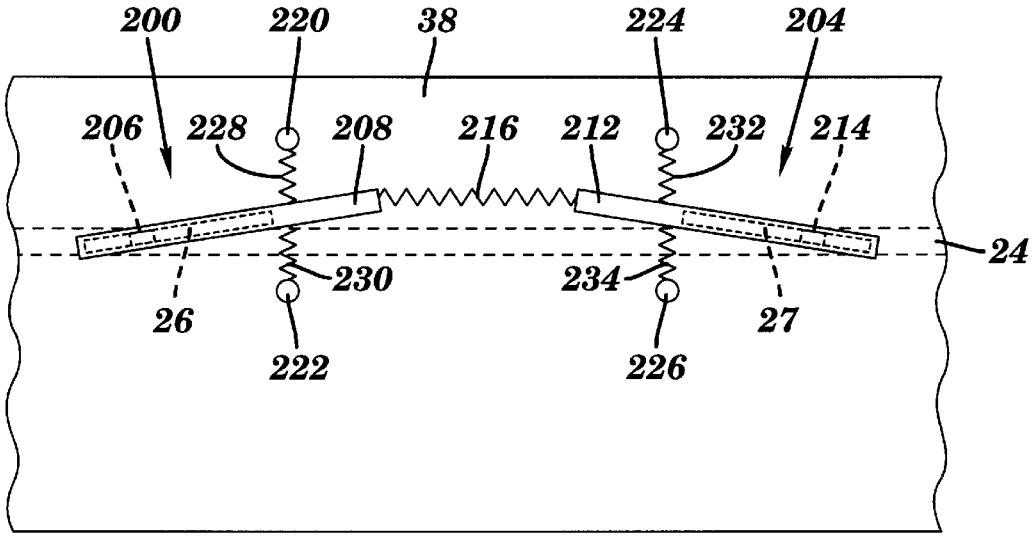
FIG. 13 illustrates a top plan view of the rudder assembly.

FIGS. 12 and 13 illustrate the rudder assemblies 200 and 204. Rudder assembly 200 includes a rudder 26, a shaft 202 and a tiller 208. The shaft 202 passes through a through hole 206 in the main hull 14 and a first end of the shaft 202 is attached to the rudder 26 and a second end of the shaft 202 is attached to the tiller 208. The shaft 202 is preferably attached toward the end 216 of the rudder 26, and the shaft 202 can rotate in the through hole 206. Rudder assembly 204 includes a rudder 27, a shaft 210, and a tiller 212. The shaft 210 passes through a through hole 214 in the main hull 14, and a first end of the shaft 214 is attached to the rudder 27 and a second end of the shaft 214 is attached to the tiller 212. The shaft 214 is preferably attached toward the end 218 of the rudder 27, and the shaft 214 can rotate in the through hole 214. When the sailboat 10 is traveling in a straight line, the rudders 26 and 27 are located in the same plane as the keel 24 in order to minimize water drag.

FIG. 13 illustrates a top plan view of the rudder assemblies 200 and 204. For steering, the operator moves the tillers 208 and 212. A resilient element 216 can link the tillers 208 and 212. The resilient element 216 can be, but is not limited to a rubber shock cord. Struts 220, 222, 224, and 226 are mounted to the deck 38. Resilient elements 228, 230, 232, and 234 link the struts 220, 222, 224 and 226 with the tiller 208 and 212. The tension provided by the resilient elements 216, 228, 230, 232, and 234 can be adjusted to provide steering such that the sailboat 10 will turn into the wind and stop if the operator releases the tillers 208 and 212.

Figure 14:
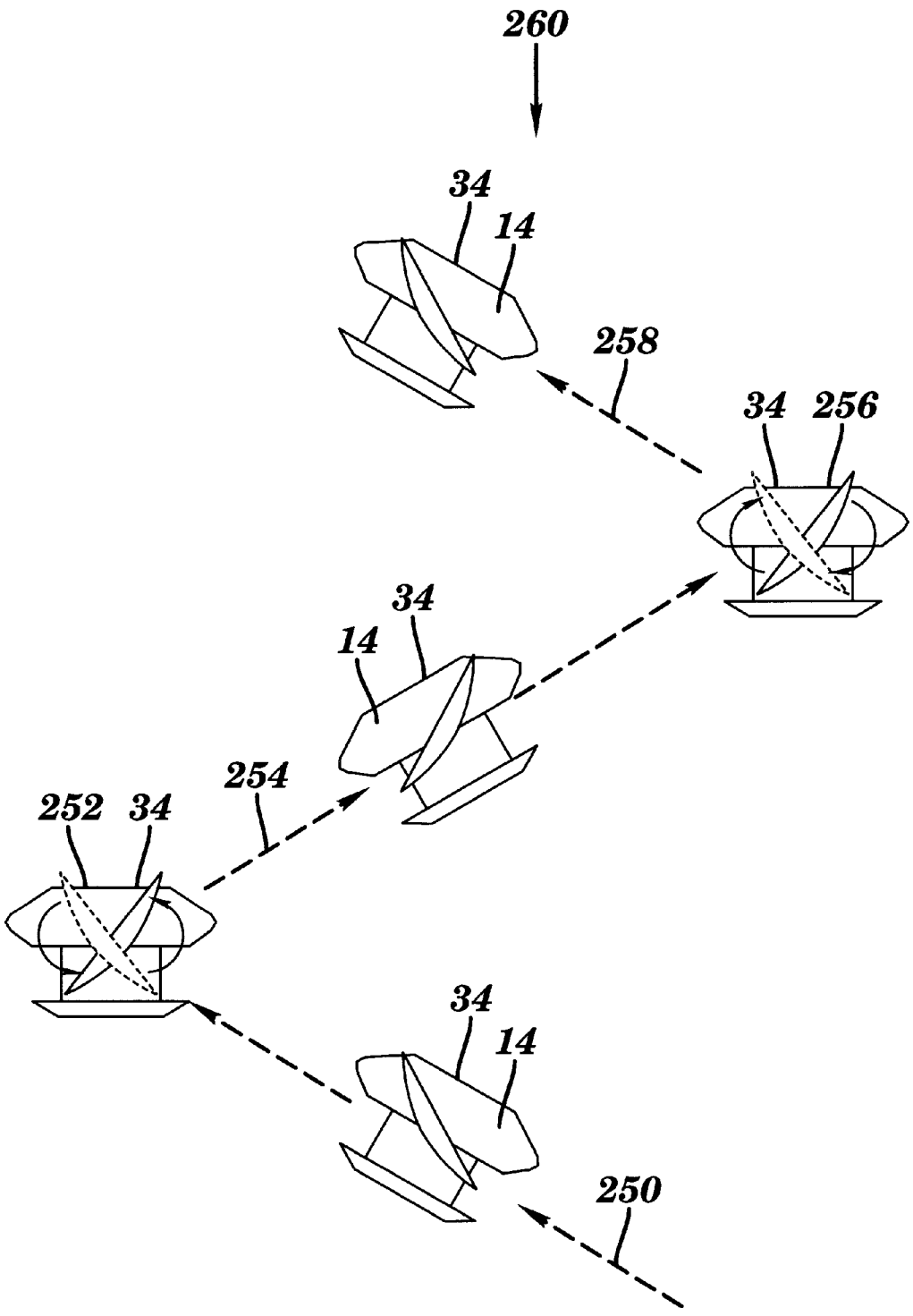
FIG. 14 illustrates a perspective view of the sailboat tacking into the wind.

Referring to FIG. 14, the method of maneuvering the sailboat 10 upwind will be described. Reference to FIG. 1 and FIG. 2 will be made in order to show the sail and control line configurations. The wind direction 260 is illustrated in FIG. 14, and when the sailboat 10 is on a course 250, the control line 46 is tightened, drawing the swiveling loop 48 on the yardarm 15 toward the line guide 54, as illustrated in FIG. 1. Control line 58 attached to the corner 56 of the sail 22, is used to control the sail 22 (FIG. 1), and the tiller 208 (FIG. 12), controlling the rudder 26 position, is used to control the sailboat direction. When the sailboat 10 reaches the point designated 252, the position of the sail is changed from FIG. 1 to FIG. 2 where the control line 46 is tightened, drawing the swiveling loop 50 on the yardarm 12 toward the line guide 52, as illustrated in FIG. 2. Control line 62 attached to the corner 56 of the sail 22, is used to control the sail 22, and the tiller 212 (FIG. 12) controlling the rudder 27 is used to control the sailboat direction along course 254.

When the sailboat 10 reaches the point designated 256, to change to the course 258, the position of the sail 22 and the control line and tiller configuration is the same as used in the 250 course heading. During sailing, the fore and aft location of the mast 18 can be varied in order to change the location of the center of pressure of the sail relative to the keel 24 (FIG. 8). As illustrated in FIG. 14, the direction of motion of the hull 14 changes, while the windward 34 side of the hull 14 remains the same.

The foregoing description of the present invention has been presented for purposes of illustration and description. It is not intended to be exhaustive or to limit the invention to the precise form disclosed, and many modifications and variations are possible in light of the above teaching. Such modifications and variations that may be apparent to a person skilled in the art are intended to be included within the scope of this invention as defined by the accompanying claims.

I claim:

1. A sailboat comprising:

a main hull symmetrical in a longitudinal direction;

a mast attached to the main hull;

a yardarm pivotally attached to a head of the mast; and a sail attached to the yardarm, wherein the sail has a plurality of sail sections; and a system for automatically joining the sail sections, as the sail is lowered from the yardarm.

2. The sailboat according to claim 1, wherein the main hull is asymmetrical in a cross-section perpendicular to the longitudinal direction of the main hull.

3. The sailboat according to claim 1, wherein the main hull further includes a sponson, a keel section, and an outrigger hull, and wherein the outrigger hull is extendably attached to the main hull by at least one outrigger arm.

4. The sailboat according to claim 1, further including a system for rotatably and pivotally attaching the mast to the main hull.

5. The sailboat according to claim 1, further including a plurality of rudders in a keel, and wherein a tiller system is attached to the rudders.

6. A sailboat comprising:

a main hull symmetrical in a longitudinal direction;

a mast attached to the main hull;

a yardarm pivotally attached to a head of the mast; and a sail attached to the yardarm, wherein the sail has a plurality of sail sections; and a system for automatically separating the sail sections, as the sail is raised onto the yardarm.

7. The sailboat according to claim 6, wherein the main hull is asymmetrical in a cross-section perpendicular to the longitudinal direction of the main hull.

8. The sailboat according to claim 6, wherein the main hull further includes a sponson, a keel section, and an outrigger hull, and wherein the outrigger hull is extendably attached to the main hull by at least one outrigger arm.

9. The sailboat according to claim 6, further including a system for rotatably and pivotally attaching the mast to the main hull.

10. The sailboat according to claim 6, further including a plurality of rudders in a keel, and wherein a tiller system is attached to the rudders.

11. A sail for a sailboat comprising:

a yardarm;

a plurality of sail sections attached to the yardarm;

and a system for automatically joining the sail sections as the sail is lowered from the yardarm, and for automatically separating the sail sections as the sail is raised onto the yardarm.

12. The sail according to claim 11, wherein the sail sections are joined using a zipper.

13. The sail according to claim 11, wherein the yardarm has a longitudinal axis and wherein the yardarm rotates about the longitudinal axis.

14. The sail according to claim 13, wherein the sail sections roll up around the yardarm as the sail is raised onto the yardarm.

* * * * *